US007438742B2

(12) United States Patent
Smith

(10) Patent No.: US 7,438,742 B2
(45) Date of Patent: Oct. 21, 2008

(54) METHOD AND APPARATUS FOR PREVENTING WEAR IN AN ELECTROSTATIC PRECIPITATOR

(75) Inventor: James Glendon Smith, Lenoir City, TN (US)

(73) Assignee: ALSTOM Technology Ltd, Baden (CH)

( * ) Notice: Subject to any disclaimer, the term of this patent is extended or adjusted under 35 U.S.C. 154(b) by 302 days.

(21) Appl. No.: 11/358,334

(22) Filed: Feb. 21, 2006

(65) Prior Publication Data

US 2007/0193449 A1 Aug. 23, 2007

(51) Int. Cl.
*B03C 3/86* (2006.01)

(52) U.S. Cl. ..... 95/57; 96/83; 96/89; 96/92; 96/93; 96/96; 248/339; 313/271; 313/272

(58) Field of Classification Search ..... 96/83, 96/88–93, 96, 97; 95/57; 313/271, 272; 248/339

See application file for complete search history.

(56) References Cited

U.S. PATENT DOCUMENTS 1,857,416 A * 5/1932 Von Eberhard ..... 313/238
2,684,730 A * 7/1954 Sohlman ..... 96/83
3,203,155 A * 8/1965 Haglund et al. ..... 96/92
3,354,617 A * 11/1967 Hoisington et al. ..... 96/91
3,483,670 A 12/1969 Quintilian et al.
3,485,011 A * 12/1969 Archer et al. ..... 95/81
3,803,809 A * 4/1974 Gelhaar et al. ..... 96/93
3,918,938 A * 11/1975 Kline ..... 96/93
3,943,418 A * 3/1976 Quang ..... 361/230
4,071,688 A * 1/1978 Lynch et al. ..... 96/88
4,115,083 A * 9/1978 Huppi ..... 96/93
4,134,040 A 1/1979 Klotzman
4,349,359 A * 9/1982 Fitch et al. ..... 96/90
4,363,932 A * 12/1982 Peace ..... 96/88
4,502,872 A 3/1985 Ivester et al.
4,514,780 A * 4/1985 Brussee et al. ..... 361/226
4,514,888 A 5/1985 Wheeler
4,666,474 A * 5/1987 Cook ..... 96/90
5,391,222 A * 2/1995 Nelson et al. ..... 96/90
6,048,385 A * 4/2000 Koide ..... 96/83
6,156,104 A * 12/2000 Jeong ..... 96/88
6,579,349 B1 * 6/2003 Ting et al. ..... 96/44
2001/0020417 A1 * 9/2001 Liu et al. ..... 96/66

FOREIGN PATENT DOCUMENTS

JP 6-91200 A * 4/1994 ..... 96/96

* cited by examiner

*Primary Examiner*—Richard L Chiesa
(74) *Attorney, Agent, or Firm*—Timothy J. Olson

(57) ABSTRACT

An apparatus for preventing wear of an electrode holder on a discharge electrode frame of an electrostatic precipitator includes an electrically conductive member having a central portion generally contoured to a shape of an electrode holder. The apparatus is fastened to at least one of the electrode holder and an end portion of a discharge electrode such that, when the end portion of the discharge electrode is attached to the electrode holder, the electrically conductive member is disposed between the end portion of the discharge electrode and the electrode holder.

15 Claims, 7 Drawing Sheets

METHOD AND APPARATUS FOR PREVENTING WEAR IN AN ELECTROSTATIC PRECIPITATOR

BACKGROUND

The present invention relates to electrostatic precipitators and, more particularly, a method and apparatus for preventing wear of electrode holders on a discharge electrode frame of an electrostatic precipitator.

In an electrostatic precipitator, a gas laden with entrained particulate material is passed through an electrostatic field established about a discharge electrode disposed between two grounded collecting electrodes. The suspended particles become electrically charged as they pass through the electrostatic field and move under the influence of the electrostatic field to deposit upon the grounded collecting electrodes flanking the discharge electrode.

Typically, each collecting electrode is formed of one or more elongated plates disposed in a row side-by-side and suspended from the top of a precipitator housing in a vertical plane. A plurality of such collecting electrodes are disposed transversely across the precipitator casing in spaced vertical planes parallel to the direction of the gas flow through the precipitator.

In what is commonly referred to as a rigid-frame electrostatic precipitator, a box-like framework comprised of a plurality of discharge electrode frames is suspended from insulators at the top of the precipitator housing. Each discharge electrode frame supports a plurality of vertically disposed discharge electrodes between adjacent collecting electrodes. The discharge electrodes are typically wires, bands, or the like, which are toughly strung across the discharge electrode frame and connected to the electrode frame at features on the electrode frame called electrode connectors. A voltage is applied to the discharge electrodes via the electrode frame to generate the electrostatic field.

During operation, some dust particles will deposit on the discharge electrodes rather than migrating to the collecting electrode plates. Therefore, it may be necessary to occasionally clean the discharge electrodes by vibrating the discharge electrode frames, typically by means of a rapping mechanism. Over time, this vibrating action as well as movement of the electrodes due to flue gas velocity and arcing between the electrode 36 and electrode holder tend to wear the end portions of the discharge electrodes and the electrode holders. Because of this wear, maintenance personnel will typically replace the discharge electrodes one or more times over the life of the electrostatic precipitator. The electrode holders are typically not replaced because this would require time-consuming disassembly of much of the electrostatic precipitator, grinding removal of the worn electrode holders, and welding attachment of the new electrode holders. Problematically, however, the worn discharge electrode holders provide uneven surfaces on which the new discharge electrodes are installed, which can cause premature wear of the new discharge electrodes.

SUMMARY

The above-described defects and deficiencies are overcome or alleviated by a method for preventing wear of electrode holders on a discharge electrode frame of an electrostatic precipitator, the method comprising: attaching electrically conductive members to at least one of: the electrode holders on the discharge electrode frame, and end portions of a discharge electrode; and attaching the discharge electrode to the discharge electrode frame such that the electrically conductive members are positioned between the end portions of the discharge electrode and the electrode holders.

In another aspect, there is provided an apparatus for preventing wear of an electrode holder on a discharge electrode frame of an electrostatic precipitator. The apparatus comprises an electrically conductive member having a central portion generally contoured to a shape of an electrode holder; and a means for fastening the central portion to at least one of the electrode holder and an end portion of a discharge electrode such that, when the end portion of the discharge electrode is attached to the electrode holder, the electrically conductive member is disposed between the end portion of the discharge electrode and the electrode holder.

In yet another aspect, there is provided an electrostatic precipitator comprising a discharge electrode frame, a plurality of discharge electrodes, and a plurality of electrically conductive members. The discharge electrode frame includes an outer frame portion generally defining a perimeter of the discharge electrode frame, and a plurality of electrode holders attached to the outer frame portion. The discharge electrodes each have a pair of end portions, and the electrically conductive members are disposed between the end portions of the discharge electrodes and the electrode holders. Each of the electrically conductive members includes: a central portion generally contoured to a shape of an electrode holder in the plurality of electrode holders; and a means for fastening the central portion to at least one of the electrode holder and an end portion of a discharge electrode in the plurality of discharge electrodes such that, when the end portion of the discharge electrode is attached to the electrode holder, the electrically conductive member is disposed between the end portion of the discharge electrode and the electrode holder.

BRIEF DESCRIPTION OF THE DRAWINGS

Referring now to the drawings wherein like items are numbered alike in the various Figures.

DETAILED DESCRIPTION

Figure 1:
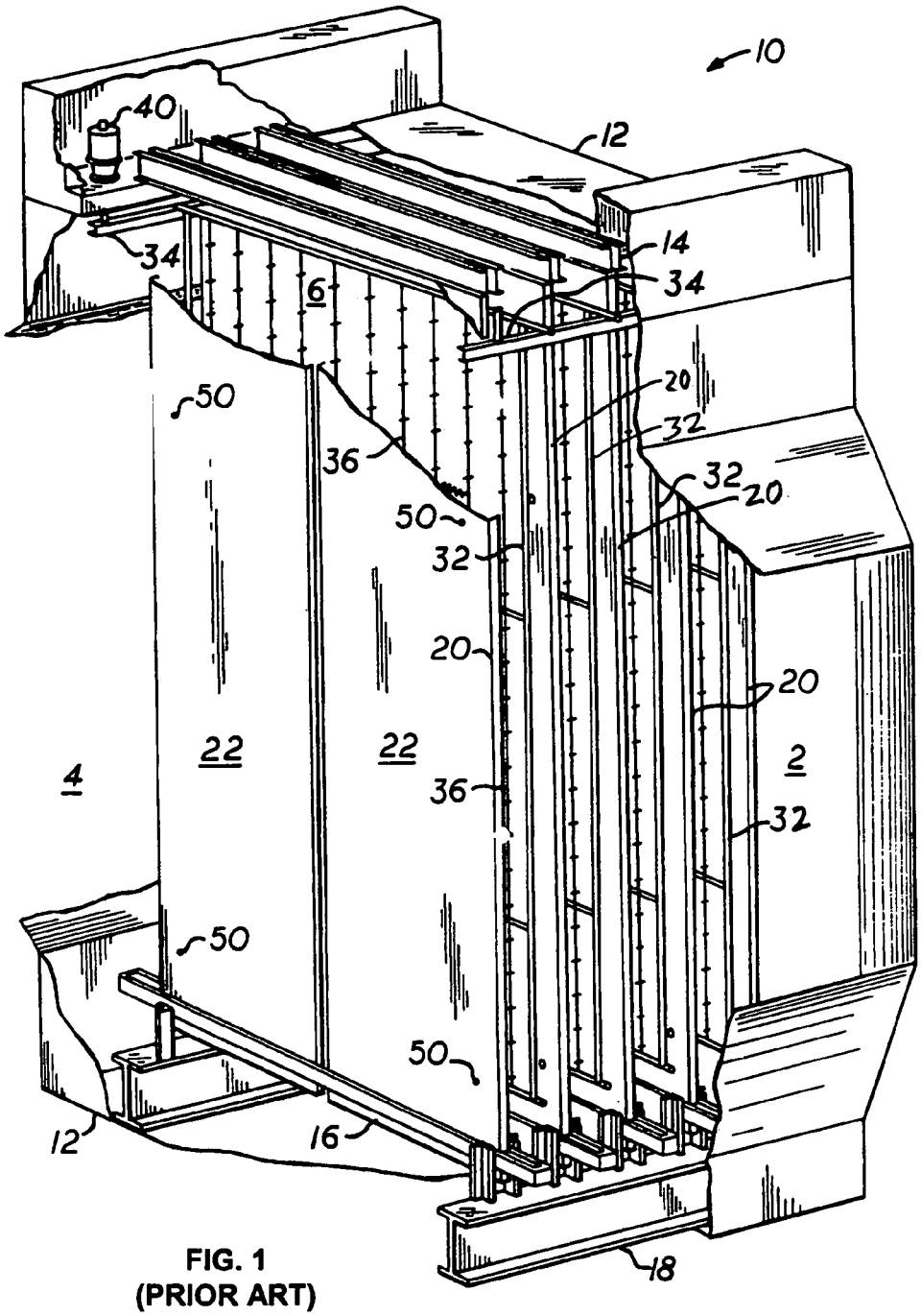
FIG. 1 (PRIOR ART)
FIG. 1 is a perspective, cut-away view of an electrostatic precipitator of the prior art.

FIG. 1 is a perspective, cut-away view of an electrostatic precipitator 10, which includes a casing 12 with an inlet 2, an outlet 4 and a precipitation chamber 6 disposed between the inlet 2 and outlet 4. The particulate laden flue gas to be cleaned passes through the housing 12 of the precipitator 10 from the gas inlet 2 through the precipitation chamber 6 and out the gas outlet 4. The precipitator 10 is shown for purposes of illustration and not limitation, and it is contemplated that the present invention may be embodied in electrostatic precipitators having a different design than that shown.

The basic configuration of the precipitator 10 shown in FIG. 1 is well known in the prior art, and is typically referred to as a rigid frame-type electrostatic precipitator. A plurality of substantially rectangular collecting electrode plates 22, forming collectively a collecting electrode plate assembly 20, are disposed in substantially parallel, spaced relationship in vertical planes within the precipitation chamber 6. Disposed in the spaces between the collecting electrode plate assemblies 20 is a plurality of discharge electrode assemblies 32. Both the collecting electrode plate assemblies 20 and the discharge electrode assemblies 32 are aligned parallel to and extend in the direction of gas flow through the precipitation chamber 6 from the inlet 2 to the outlet 4 thereof.

Each collecting electrode plate 22 is suspended and supported from upper support beams 14 disposed across the top of the precipitation chamber 6. The lower end of each of the suspended collecting electrode plates 22 is laterally constrained from movement by inserting it into a guide member 16 which is mounted to the lower support beams 18 disposed in the bottom of the precipitation chamber 6. Thus, the suspended electrode plates 22, which may range anywhere from 12 to 50 feet in height, are free to move vertically downward within the guide members 16 due to temperature effects but are constrained from any lateral movement by guide members 16.

The collecting electrode plates 22 are shown in the drawing as being of a particular cross section merely for purposes of illustration and not limitation. It is to be understood that the present invention contemplates utilizing collecting electrode plates of any of a number of cross-sectional designs with the particular design utilized in any given situation being selected on an individual basis to give optimal precipitation efficiency and a quiescent zone at the surface of the collecting electrode plates 22.

Figure 2:
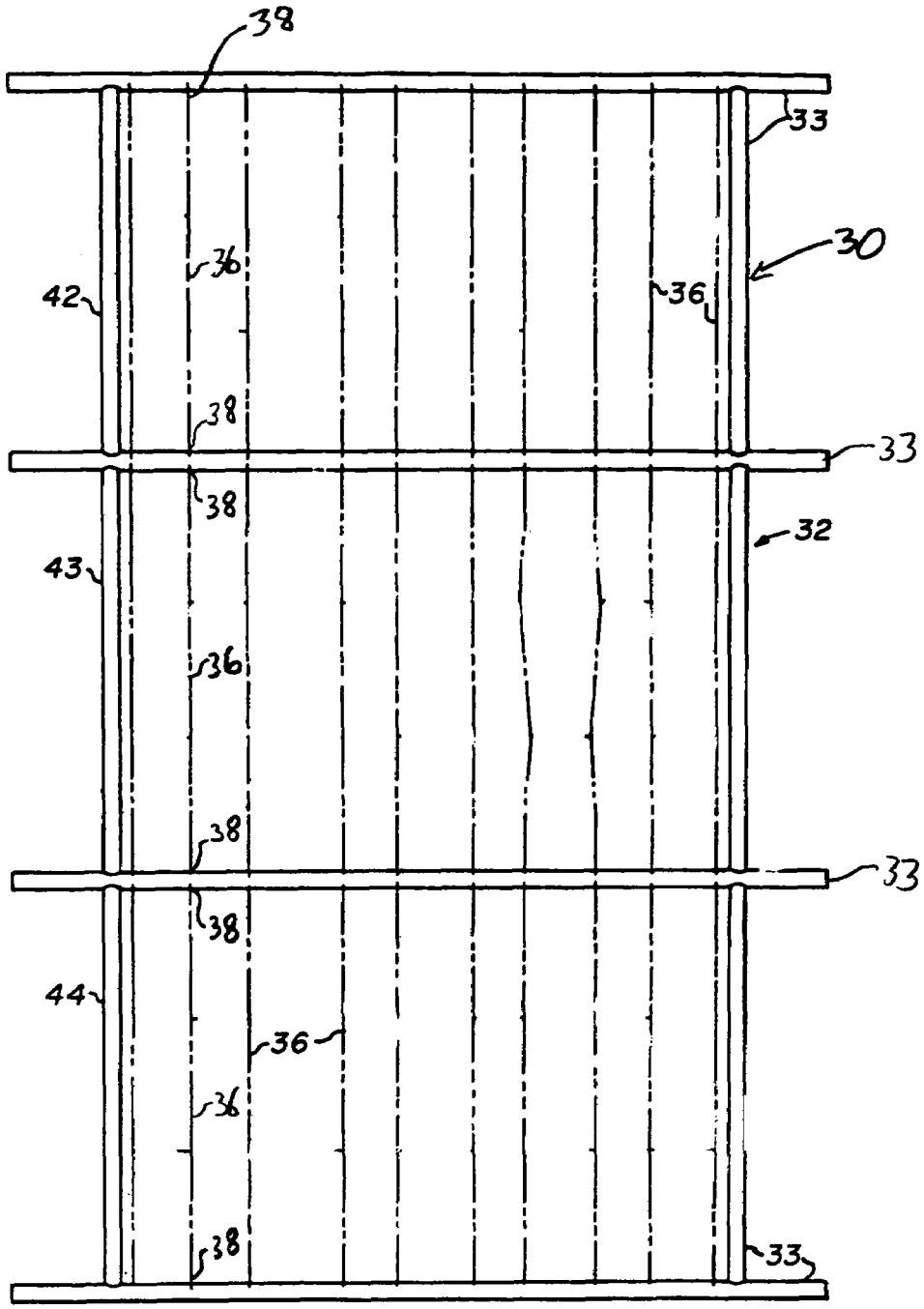
FIG. 2 (PRIOR ART)
FIG. 2 is a side elevation view of a discharge electrode frame of the prior art having discharge electrodes attached thereto.

The individual discharge electrode assemblies 32 are supported and suspended from a support beams 34 disposed at the top of the precipitation chamber 6 and mounted to the casing 12 through electrical insulators 40. As best seen in FIG. 2, each of the individual discharge electrode assemblies 32 includes rigid vertical and horizontal support members 33 which may be welded or otherwise fastened together to form a discharge electrode frame 30. The support members 33 generally define a perimeter of the discharge electrode frame, and intermediate support members 33 may be welded between vertical support members 33 so as to divide a discharge electrode frame 30 into upper, middle and lower sections 42, 43 and 44 respectively.

Referring to FIG. 1 and FIG. 2, mounted within each section 42, 43 and 44 of the discharge electrode frame 30 are a plurality of vertically strung discharge electrodes 36 disposed at spaced intervals along the direction of gas flow so as to provide an electrostatic field along the length at a precipitation chamber 6. End portions 38 of each discharge electrode 36 are mechanically and electrically connected to the support members 33. The discharge electrodes 36 may be tensioned to limit the movement of the discharge electrodes 36 relative to the frame 30 and to ensure good electrical contact between the discharge electrodes 36 and the frame 30.

Although any number of discharge electrode designs may be utilized, the typical discharge electrode 36 comprises one of: a spirally-wound wire element; a flat, thin, rectangular in cross-section strip-like element; or a round wire-like element having a plurality of corona discharge points (e.g., barbs) disposed at spaced intervals along its length. Other discharge electrode designs that may be employed include smooth round wires, twisted or spiraled wires or bands, twisted wire pairs, barbed wires or bands, saw tooth bands, or any combination of such designs. It is to be understood that the present invention contemplates utilizing discharge electrodes of any of a number of designs with the particular design utilized in any given situation being selected on an individual basis to give optimal precipitation efficiency.

Figure 3:
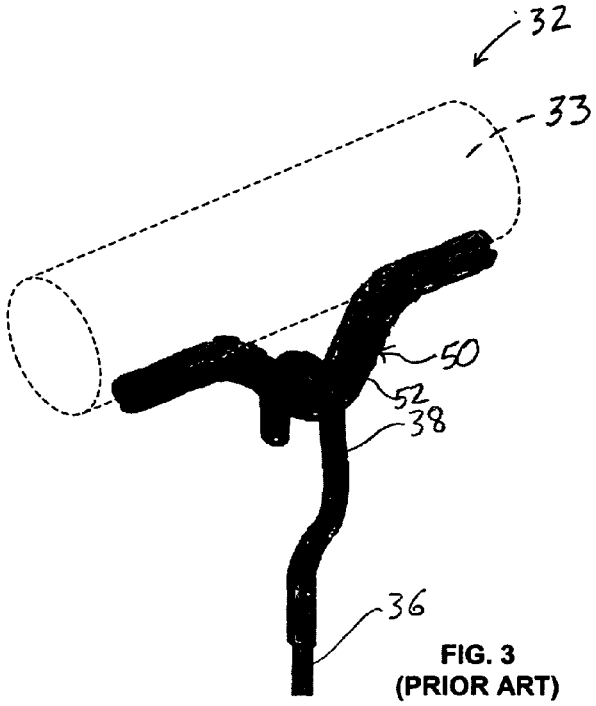
FIG. 3 (PRIOR ART)
FIG. 3 is a perspective view of a portion of the discharge electrode frame of the prior art, depicting an end portion of a single discharge electrode attached to an electrode holder on the discharge electrode frame.

Referring to FIG. 3, a portion of the discharge electrode assembly 32, depicting an example of a connection between an end portion 38 of a discharge electrode 36 and a support member 33, is shown. For purposes of clarity, only one electrode holder 50 and end portion 38 is shown; however, it will be appreciated that the discharge electrode assembly 32 will include a plurality of electrode holders 50, one for each end portion 38 of the discharge electrodes 36.

In the example shown in FIG. 3, the support member 33 includes an electrode holder 50 attached thereto for receiving the end portion 38 of the discharge electrode. The electrode holder 50 is formed by a rigid bar having a circular cross-sectional shape, which is attached to the support member 33 by welding or other fastener. The electrode holder 50 has a generally V-shaped central portion 52, with a surface of the electrode holder proximate a crux of the V-shaped portion 52 being in contact with the end portion 38 of the discharge electrode 36. The end portion 38 includes a rigid, hook-shaped sleeve disposed over the otherwise flexible discharge electrode 36. It is contemplated that the electrode holder 50 and end portion 38 may be of any convenient design. For example, the electrode holder 50 may be formed as a notch on, or hole in the support member 33, which receives the end portion 38 of the discharge electrode 36. As such, the term "electrode holder", as used herein, includes any portion of the frame that receives an end portion of a discharge electrode. Likewise, the end portion 38 may be of any design that provides electrical and mechanical coupling between the electrode holder 50 and discharge electrode 36.

Referring to FIGS. 1-3, in operation, a particulate laden gas enters the precipitator casing 12 through the inlet 2 thereof and flows through the precipitation chamber 6 to the outlet 4. In traversing the precipitation chamber 6, the particulate laden gas flows in the space between the collecting electrode plate assemblies 20 and the discharge electrode assemblies 32. Due to the action of the corona formed about the discharge electrodes 36 and the electrostatic field extending between the discharge electrodes 36 and the collecting electrode plates 22, the particulates within the gas are ionized and migrate to and deposit upon the collecting electrode plates 22. However, some dust particles will, rather than migrating to the collecting electrode plates 22, deposit on the discharge electrodes 36. Therefore, it is necessary to occasionally clean the discharge electrodes 36 by vibrating the discharge electrode frames 32 typically by means of a rapping mechanism, not shown.

Over time, this vibrating action as well as movement of the electrodes 36 due to flue gas velocity and arcing between the electrode 36 and electrode holder 50 tend to wear the end portions 38 of the electrodes 36 and the electrode holders 50. Because of this wear, maintenance personnel will typically replace the discharge electrodes 36 one or more times over the life of the electrostatic precipitator 10. The electrode holders 50 are typically not replaced because this would require time-consuming disassembly of much of the electrostatic precipitator 10, grinding removal of the worn electrode holders 50, and welding attachment of the new electrode holders 50. Problematically, however, the worn discharge electrode holders 50 provide uneven surfaces on which the new discharge electrodes 36 are installed, which can cause premature wear of the new discharge electrodes 36.

Figure 4:
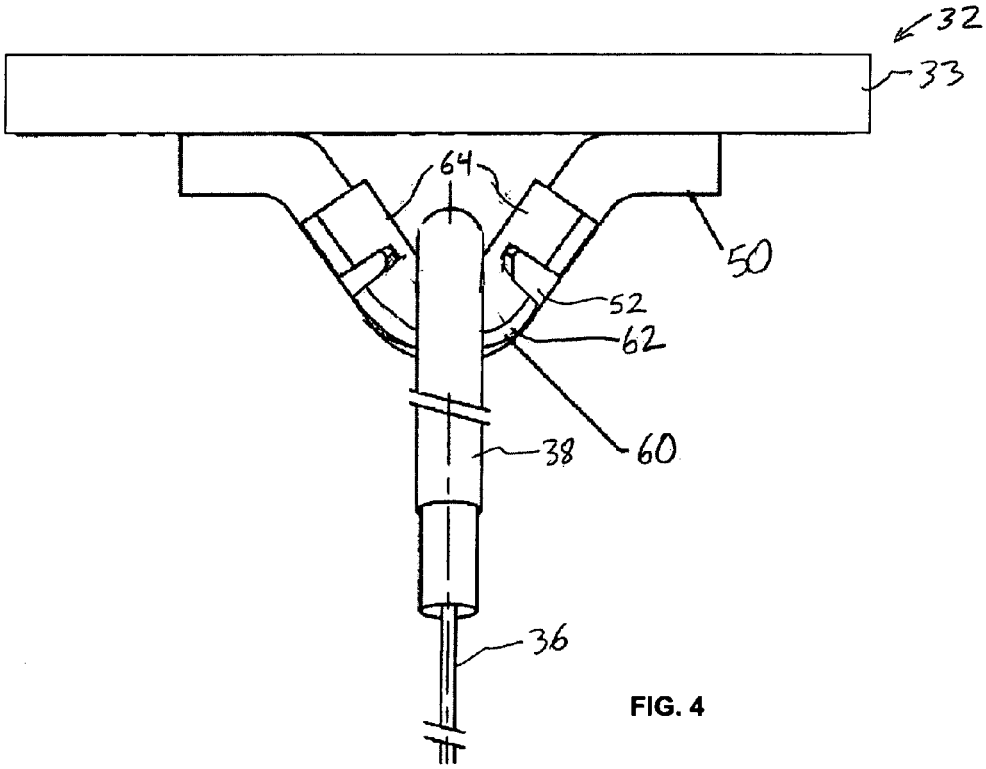
FIG. 4 is a side elevation view of an electrically conductive member disposed between the end portion of the discharge electrode and the electrode holder, in accordance with an embodiment of the present invention.

Referring to FIG. 4, in accordance with various embodiments of the present invention, an electrically conductive member 60 is disposed between the discharge electrode holder 50 and the end portion 38 of the discharge electrode 36. The electrically conductive member 60 provides a wear surface that can be replaced along with the discharge electrodes 36, thus extending the life of the discharge electrode holders 50 by preventing wear of the discharge electrode holders 50. This is accomplished without the need for welding repairs, which can be time consuming. Also, the electrically conductive member 60 is believed to increase the life of the discharge electrodes 36 by providing a smooth surface on which to mount the end portions 38 of the discharge electrodes 36 each time the discharge electrodes 36 are replaced. While the electrically conductive members 60 are particularly useful when installing new discharge electrodes 36 onto worn electrode holders 50, it is contemplated that the electrically conductive members 60 may be installed on a new frame 30, thus helping to prevent any wear of the electrode holders 50.

In general, the electrically conductive member 60 is a rigid structure formed from an electrically conductive material (e.g., a metal) and having a central portion 62 that is generally contoured to a shape of the electrode holder 50. By "generally contoured to a shape of the electrode holder" it is meant that the central portion 62 has a surface shaped similarly to a surface on the electrode holder. As a result of being contoured to the shape of the electrode holder 50, an electrical connection can be established between the electrically conductive member 60 and the electrode holder 50 when the electrically conductive member 60 is attached to the electrode holder 50. The electrically conductive member 60 may be formed from a material having a hardness less than or equal to a hardness of the electrode holder 50, thus preventing wear of the electrode holder 50. The end portion 38 of the discharge electrode 36 contacts an outer surface of the central portion 62, which is a generally smooth surface to prevent wear of the discharge electrode 36 and promote an electrical connection between the discharge electrode 36 and the electrically conductive member 60.

Figure 5:
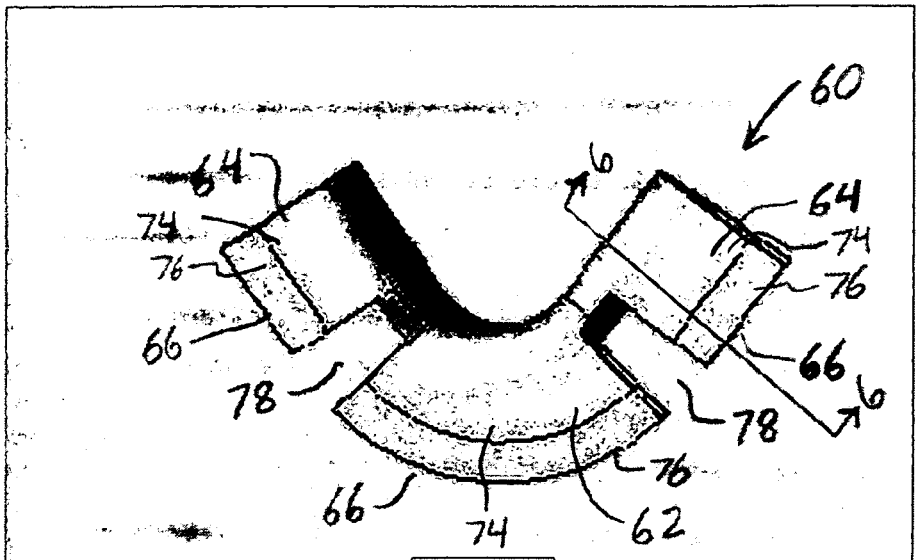
FIG. 5 is a side elevation view of the electrically conductive member of FIG. 4.

In the embodiment of FIG. 4, the electrically conductive member 60 includes end portions 64, which are disposed on opposite sides of the central portion 62. The end portion 38 of the discharge electrode 36 rests on the central portion 62 of the electrically conductive member 60, which is positioned at the crux of the V-shaped portion 52. As shown in FIG. 5, the electrically conductive member 60 is also generally contoured to a V-shape to promote electrical contact between the electrically conductive member 60 and the electrode holder 50.

The electrically conductive member 60 also includes fastening means 66 for fastening the central portion 62 to the electrode holder 50, thereby facilitating the installation of the electrically conductive member 60. For example, during installation of the electrically conductive member 60 and the discharge electrode 36 onto the electrode holder 50, a technician may use the fastening means 66 to first secure the electrically conductive member 60 to the electrode holder 50, and thereafter the technician can attach the discharge electrode 36. The fastening means 66 simplifies the installation process. Once the discharge electrode 36 and electrically conductive member 60 are installed, tension in the discharge electrode 36 helps to retain the electrically conductive member 60 between the end portion 38 and the electrode holder 50.

Figure 6:
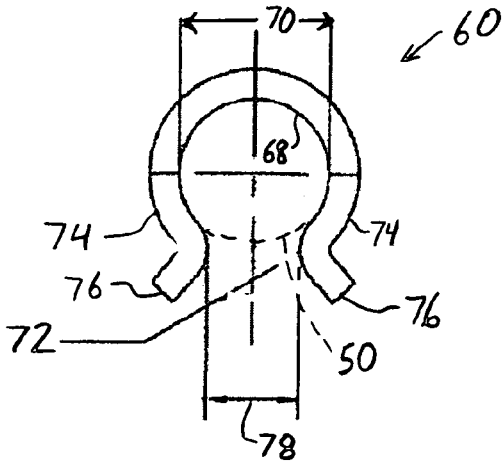
FIG. 6 is a sectional view of the electrically conductive member taken along section 6-6 of FIG. 5.

FIG. 6 is a cross-sectional view of an end portion 64 of the electrically conductive member 60 taken along section 6-6 of FIG. 5. It will be appreciated that both end portions 64 and the central portion 62 may have a similar cross-section. The electrically conductive member 60 has an internal surface 68 that is contoured to an external surface of the electrode holder 50. In the embodiment shown, the internal surface 68 is radiused with a diameter 70 approximately equal to an outside diameter of the electrode holder 50. The electrically conductive member 60 has an opening 72 formed therein, which separates and partially defines two leg portions 74. Each leg portion 74 has an outwardly rolled edge 76, and a distance 78 between the leg portions 74 (i.e., the width of the opening 72) is less than the outside diameter of the electrode holder 50. To install the electrically conductive member 60 onto the electrode holder 50, the electrode holder 50 is first positioned at the opening 72, and then the electrically conductive member 60 is forced onto the electrode holder 50 such that the electrode holder 50 is received within the radiused inside diameter of the electrically conductive member 60, as depicted in FIG. 6. Thus, the legs 74 provide a clamp for attaching the electrically conductive member 60 to the electrode holder 50. As can be seen in FIG. 5, notches 78 are disposed between the central portion 62 and the end portions 64 to allow the leg portions 74 to flex as the electrically conductive member 60 is being installed onto the electrode holder 50.

In the embodiment of FIG. 5, the central portion 62 has substantially the same cross sectional shape as the end portions 64, which is shown in FIG. 6. Thus, the central portion 62, in addition to the end portions 64, have leg portions 74 for attaching the electrically conductive member 60 to the electrode holder 50. Alternatively, it is contemplated that only the end portions 64 include leg portions 74. In this embodiment, the central portion 62 would not assist in fastening the electrically conductive member 60 to the electrode holder 50. In another alternative embodiment, it is contemplated that the electrically conductive member 60 includes only a central portion 62 having a cross-sectional shape as depicted in FIG. 6, with no end portions 64.

Figure 7:
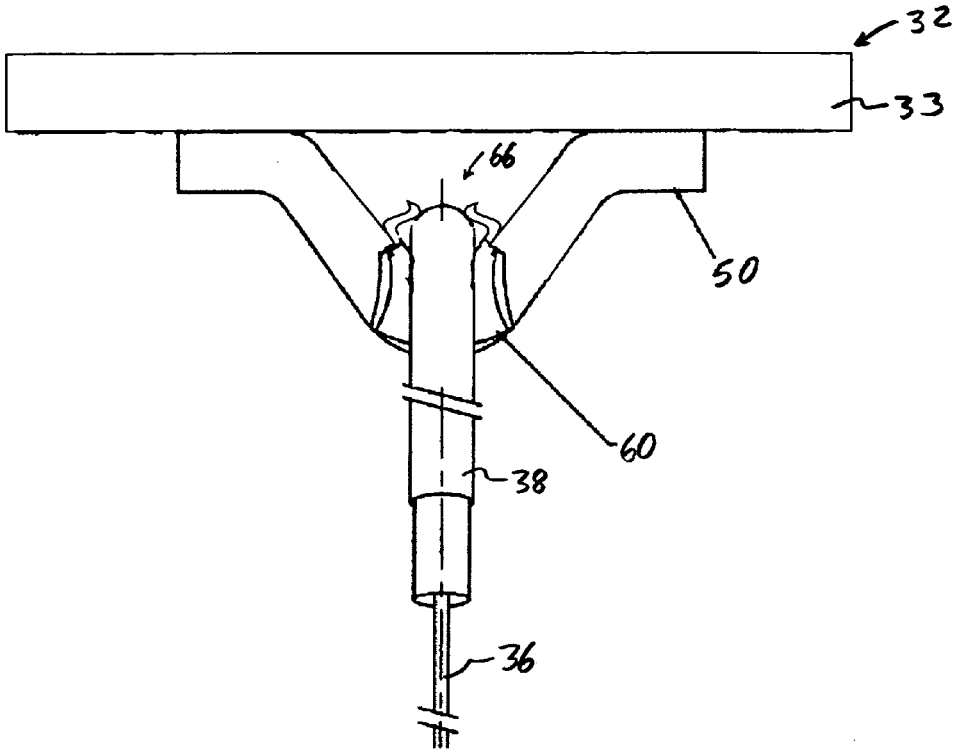
FIG. 7 is a side elevation view of an electrically conductive member disposed between the end portion of the discharge electrode and the electrode holder, in accordance with another embodiment of the present invention.
Figure 8:
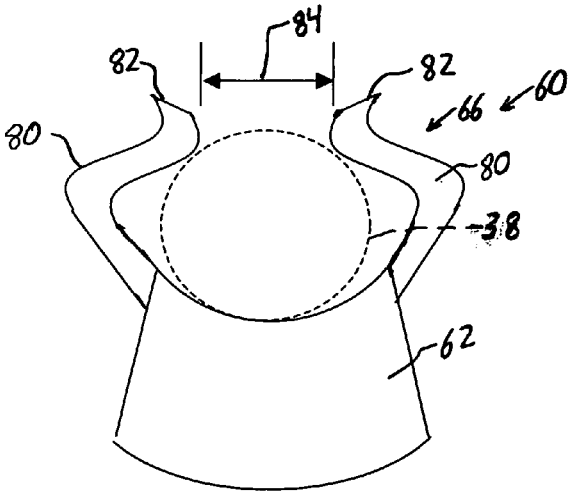
FIG. 8 is a side elevation view of the electrically conductive member of FIG. 7.
Figure 9:
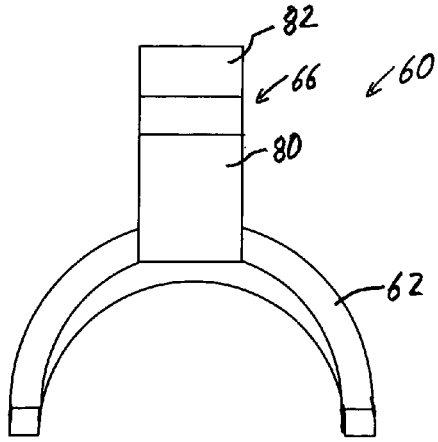
FIG. 9 is a front elevation view of the electrically conductive member of FIG. 7.

FIG. 7 depicts an alternative electrically conductive member 60, which is shown disposed between the end portion 38 of the discharge electrode 36 and the electrode holder 50. FIG. 8 is a side elevation view of the electrically conductive member 60 of FIG. 7; and FIG. 9 is a front elevation view of the electrically conductive member 60 of FIG. 7. In this embodiment, the central portion 62 includes a fastening means 66 that is configured to attach the electrically conductive member 60 to the end portion 38 of the discharge electrode 36. For example, during installation of the electrically conductive member 60 and the discharge electrode 36 onto the electrode holder 50, a technician may use the fastening means 66 to first secure the electrically conductive member 60 to the discharge electrode 36, and thereafter the technician can attach the discharge electrode 36 and the electrically conductive member 60 to the electrode holder 50. The fastening means 66 simplifies the installation process. Once the discharge electrode 36 and electrically conductive member 60 are installed, tension in the discharge electrode 36 helps to retain the electrically conductive member 60 between the end portion 38 and the electrode holder 50.

In the embodiment of FIG. 8, the fastening means 66 is comprised of leg portions 80, which are configured to clamp onto the end portion 38 of the discharge electrode 36. Each leg portion 80 has an outwardly rolled edge 82, and a distance 84 between the leg portions 80 is less than the outside diameter of the end portion 38 of the discharge electrode 36. The electrically conductive member 60 is attached to the discharge electrode 36 by positioning the end portion 38 between the leg portions 80, and forcing the electrically conductive member 60 onto the end portion 38 such that the end portion 38 is received between the leg portions 80, as shown in FIG. 8.

Figure 10:
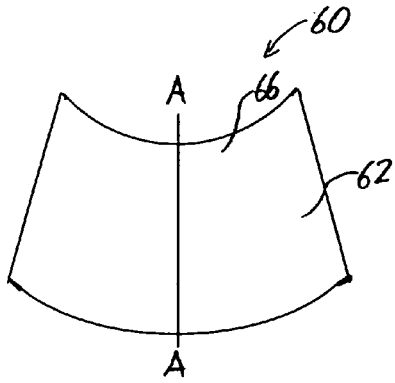
FIG. 10 is a side elevation view of an electrically conductive member in accordance with another embodiment of the present invention.
Figure 11:
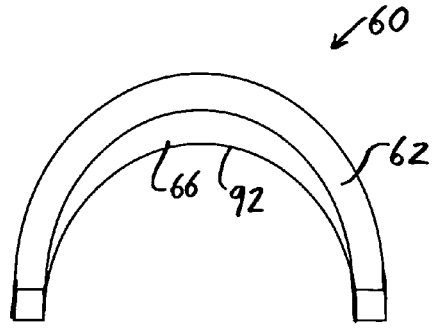
FIG. 11 is a front elevation view of the electrically conductive member of FIG. 10.

FIG. 10 is a side elevation view of another alternative electrically conductive member 60; and FIG. 11 is a front elevation view of the electrically conductive member of FIG. 10. In the embodiment of FIGS. 10 and 11, the fastening means 66 may comprise an adhesive or magnetic material. For example, an adhesive may be placed on either a top surface 90 or a bottom surface 92 of the electrically conductive member 60 for use in attaching the electrically conductive member 60 to the discharge electrode 38 or to the electrode holder 50, respectively. Alternatively, all or part of the material forming the electrically conductive member 60 may be magnetic, thus allowing the electrically conductive member 60 to be magnetically attached to either the discharge electrode 36 or to the electrode holder 50.

Figure 12:
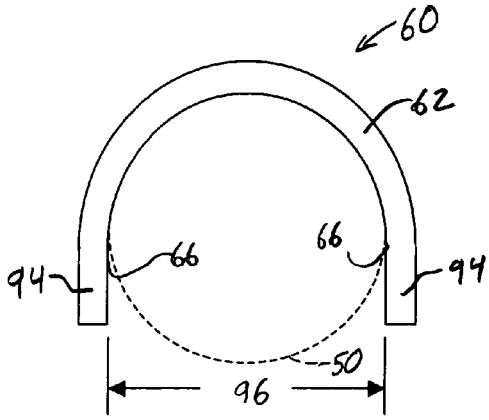
FIG. 12 is a section view of the electrically conductive member of FIG. 10, taken along line A-A of FIG. 10.
Figure 13:
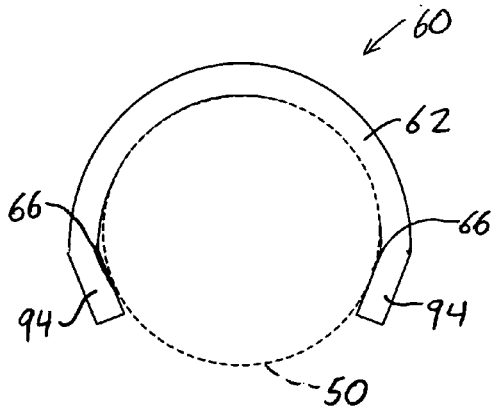
FIG. 13 is a section view of the electrically conductive member of FIG. 10, taken along line A-A of FIG. 10, after crimping the leg portions of the electrically conductive member.

FIG. 12 is a section view of the electrically conductive member of FIG. 10, taken along line A-A of FIG. 10. As can be seen in FIG. 12, the central portion 62 includes leg portions 94, which extend therefrom. The leg portions 94 may be separated by a distance 96, which may be less than the outside diameter of the electrode holder 50, thereby establishing an interference (press) fit between the leg portions 94 and the electrode holder. The interference fit may provide at least a portion of the fastening means 66. The fastening means 66 may also be provided by crimping the leg portions 94 toward the electrode holder 50, as shown in FIG. 13, with or without the use of the interference fit.

Figure 14:
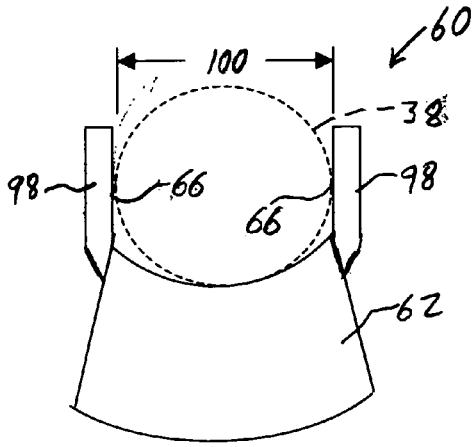
FIG. 14 is a side elevation view of an electrically conductive member in accordance with another embodiment of the present invention.
Figure 15:
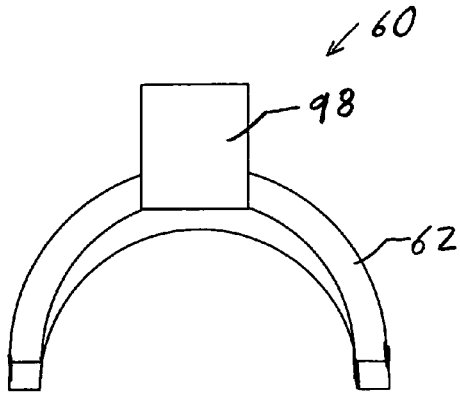
FIG. 15 is a front elevation view of the electrically conductive member of FIG. 14.

FIG. 14 is a side elevation view of another alternative electrically conductive member 60; and FIG. 15 is a front elevation view of the electrically conductive member of FIG. 14. In the embodiment of FIGS. 14 and 15, the central portion 62 includes leg portions 98, which extend therefrom. The leg portions 98 may be separated by a distance 100, which may be less than the end portion 38 of the discharge electrode 36, thereby establishing an interference (press) fit between the leg portions 98 and the end portion 38. The interference fit may provide at least a portion of the fastening means 66. The fastening means 66 may also be provided by crimping the leg portions 98 toward the end portion 38, with or without the use of the interference fit.

It should be understood that, unless stated otherwise herein, any of the features, characteristics, alternatives or modifications described regarding a particular embodiment herein may also be applied, used, or incorporated with any other embodiment described herein. For example, it is contemplated that any of the various means 66 for fastening the electrically conductive member 60 to the electrode holder 50 and/or to the discharge electrode 36 may be used alone or in combination with other such means 66. Also, the drawings herein are not drawn to scale.

Since the invention is susceptible to various modifications and alternative forms, it should be understood that the invention is not intended to be limited to the particular forms disclosed. Rather, the scope of the invention extends to all modifications, equivalents and alternatives falling within the spirit and scope of the invention as defined by the appended claims.

What is claimed is:

1. A method for preventing wear of electrode holders on a discharge electrode frame of an electrostatic precipitator, the method comprising:

attaching electrically conductive members to at least one of:

the electrode holders on the discharge electrode frame, and end portions of a discharge electrode; and attaching the discharge electrode to the discharge electrode frame such that the electrically conductive members are positioned between the end portions of the discharge electrode and the electrode holders, wherein the electrically conductive members each include:

a central portion generally contoured to a shape of the electrode holder; and a means for fastening the central portion to at least one of the electrode holder and an end portion of a discharge electrode such that, when the end portion of the discharge electrode is attached to the electrode holder, the electrically conductive member is disposed between the end portion of the discharge electrode and the electrode holder.

2. The method of claim 1, wherein the means for fastening includes at least one of: a clamp, a magnet, an adhesive, an interference fit between the electrically conductive member and the at least one of the electrode holder and the end portion of the discharge electrode, and a crimped portion of the electrically conductive member.

3. The method of claim 2, wherein each of the electrode holders includes a generally V-shaped portion having a circular cross-sectional shape, the central portion is generally contoured to the crux of the V-shaped portion, and the means for fastening includes at least one of:

leg portions disposed on the central portion and configured to receive the at least one of the electrode holder and the end portion of the discharge electrode therebetween; and end portions disposed on opposite sides of the central portion, the end portions each including leg portions configured to receive the at least one of the electrode holder and the end portion of the discharge electrode therebetween.

4. The method of claim 3, wherein at least one of the leg portions on the central portion and the leg portions on the end portions are separated by a distance less than or equal to a diameter of the at least one of the electrode holder and the end portion of the discharge electrode to provide at least a portion of the means for fastening.

5. The method of claim 3, further comprising:

crimping the at least one of the leg portions on the central portion and the leg portions on the end portions to provide at least a portion of the means for fastening.

6. The method of claim 1, wherein attaching the discharge electrode to the discharge electrode frame includes:

providing a tension in the discharge electrode that is suitable for retaining the electrically conductive members between the ends portions and the electrode holders.

7. An appararus for preventing wear of an electrode holder on a discharge electrode frame of an electrostatic precipitator, the apparatus comprising:

an electrically conductive member having a central portion generally contoured to a shape of an electrode holder; and a means for fastening the central portion to at least one of the electrode holder and an end portion of a discharge electrode such that, when the end portion of the discharge electrode is attached to the electrode holder, the electrically conductive member is disposed between the end portion of the discharge electrode and the electrode holder, wherein the means for fastening includes at least one of: a clamp, a magnet, an adhesive, an interference fit between the electrically conductive member and the at least one of the electrode holder and the end portion of the discharge electrode, and a crimped portion of the electrically conductive member.

8. The apparatus of claim 7, wherein each of the electrode holders includes a generally V-shaped portion having a circular cross-sectional shape, the central portion is generally contoured to the crux of the V-shaped portion, and the means for fastening includes at least one of:

leg portions disposed on the central portion and configured to receive the at least one of the electrode holder and the end portion of the discharge electrode therebetween; and end portions disposed on opposite sides of the central portion, the end portions each including leg portions configured to receive the at least one of the electrode holder and the end portion of the discharge electrode therebetween.

9. The apparatus of claim 8, wherein at least one of the leg portions on the central portion and the leg portions on the end portions are separated by a distance less than or equal to a diameter of the at least one of the electrode holder and the end portion of the discharge electrode to provide at least a portion of the means for fastening.

10. The apparatus of claim 8, wherein the means for fastening includes a crimped portion of the at least one of the leg portions on the central portion and the leg portions on the end portions.

11. The apparatus of claim 7, wherein a tension in the discharge electrode retains the electrically conductive member between the ends portion of the discharge electrode and the electrode holder.

12. An electrostatic precipitator comprising:

a discharge electrode frame including:

an outer frame portion generally defining a perimeter of the discharge electrode frame, and a plurality of electrode holders attached to the outer frame portion;

a plurality of discharge electrodes attached to the electrode holders, each discharge electrode having a pair of end portions; and a plurality of electrically conductive members disposed between the end portions of the discharge electrodes and the electrode holders, each of the electrically conductive members including:

a central portion generally contoured to a shape of an electrode holder in the plurality of electrode holders, and a means for fastening the central portion to at least one of the electrode holder and an end portion of a discharge electrode in the pluratilly of discharge electrodes such that, when the end portion of the discharge electrode is attached to the electrode holder, the electrically conductive member is disposed between the end portion of the discharge electrode and the electrode holder, wherein the means for fastening includes at least one of: a clamp, a magnet, an adhesive, an interference fit between the electrically conductive member and the at least one of the electrode holder and the end portion of the discharge electrode, and a crimped portion of the electrically conductive member.

13. The electrostatic precipitator of claim 12, wherein each of the electrode holders includes a generally V-shaped portion having a circular cross-sectional shape, the central portion is generally contoured to the crux of the V-shaped portion, and the means for fastening includes at least one of:

leg portions disposed on the central portion and configured to receive the at least one of the electrode holder and the end portion of the discharge electrode therebetween; and end portions disposed on opposite sides of the central portion, the end portions each including leg portions configured to receive the at least one of the electrode holder and the end portion of the discharge electrode therebetween.

14. The electrostatic precipitator of claim 13, wherein at least one of the leg portions on the central portion and the leg portions on the end portions are separated by a distance less than or equal to a diameter of the at least one of the electrode holder and the end portion of the discharge electrode to provide at least a portion of the means for fastening.

15. The electrostatic precipitator of claim 13, wherein the means for fastening includes a crimped portion of the at least one of the leg portions on the central portion and the leg portions on the end portions.

* * * * *